US010501236B2

(12) United States Patent
Van Der Kevie et al.

(10) Patent No.: US 10,501,236 B2
(45) Date of Patent: Dec. 10, 2019

(54) SHIPPING CONTAINER FOR TRANSPORTING WORKS OF ART

(71) Applicant: Turtle B.V., The Hague (NL)

(72) Inventors: Giel Van Der Kevie, The Hague (NL); Hizkia Van Kralingen, The Hague (NL)

(73) Assignee: Turtle B.V., The Hauge (NL)

( * ) Notice: Subject to any disclaimer, the term of this patent is extended or adjusted under 35 U.S.C. 154(b) by 0 days.

(21) Appl. No.: 15/769,246

(22) PCT Filed: Oct. 18, 2016

(86) PCT No.: PCT/NL2016/050715

§ 371 (c)(1),
(2) Date: Apr. 18, 2018

(87) PCT Pub. No.: WO2017/069618

PCT Pub. Date: Apr. 27, 2017

(65) Prior Publication Data

US 2018/0305083 A1 Oct. 25, 2018

(30) Foreign Application Priority Data

Oct. 19, 2015 (NL) ..... 2015635
Apr. 8, 2016 (NL) ..... 2016568

(51) Int. Cl.
*B05C 17/00* (2006.01)
*B44D 3/00* (2006.01)
(Continued)

(52) U.S. Cl.
CPC ..... *B65D 25/24* (2013.01); *B65D 5/509* (2013.01); *B65D 81/057* (2013.01);
(Continued)

(58) Field of Classification Search
CPC ..... B65D 5/509; B65D 81/3811; B65D 81/3823; B65D 81/057; B65D 81/113;
(Continued)

(56) References Cited

U.S. PATENT DOCUMENTS 4,664,254 A 5/1987 Sitwell et al.
9,205,951 B1 * 12/2015 Roman ..... B65D 21/0233
(Continued)

FOREIGN PATENT DOCUMENTS

GE 93 06 878 U1 8/1993
NL 1004045 A1 11/1996
WO 2005/021403 A1 3/2005

OTHER PUBLICATIONS

International Search Report and Written Opinion of the International Searching Authority in International Patent Application No. PCT/NL2016/050715, dated Dec. 21, 2016.

*Primary Examiner* — Rafael A Ortiz
(74) *Attorney, Agent, or Firm* — Venable LLP

(57) ABSTRACT

The invention is directed to a shipping container 1 for transporting works of art 2 comprising an enclosing section 3 obtained by injection moulding and a cover section 7 obtained by injection moulding, retaining means 9 to secure the cover section 7 to the wall sections of the enclosing section 3. The retaining means 9 are not present on at least one wall section 10. Said one wall section 10 is not provided with retaining means 9 and is provided with one or more support strips 11 along the length of the side wall 10.

13 Claims, 3 Drawing Sheets

(51) Int. Cl.

| | |
|---|---|
| ***B44D 3/04*** | (2006.01) |
| ***B65D 25/24*** | (2006.01) |
| ***B65D 81/113*** | (2006.01) |
| ***B65D 5/50*** | (2006.01) |
| ***B65D 81/05*** | (2006.01) |

(52) U.S. Cl.
CPC .. *B65D 81/113* (2013.01); *B65D 2519/00482* (2013.01); *B65D 2519/00487* (2013.01)

(58) Field of Classification Search
CPC ..... B65D 25/24; B65D 2519/00482; B65D 2519/00487; B44D 3/04; B44D 3/00; B44D 3/02; B05C 17/00
USPC ..... 206/1.7, 1.8, 1.9
See application file for complete search history.

(56) References Cited

U.S. PATENT DOCUMENTS

| | | | | |
|---|---|---|---|---|
| 2004/0124112 | A1 | 7/2004 | Kuhn et al. | |
| 2010/0072211 | A1* | 3/2010 | Dickinson | B65D 43/16 220/592.27 |
| 2014/0308432 | A1* | 10/2014 | VanGemert | B05D 5/005 427/8 |
| 2014/0360907 | A1* | 12/2014 | Fan | B62B 3/005 206/486 |

* cited by examiner

SHIPPING CONTAINER FOR TRANSPORTING WORKS OF ART

This application is a national stage entry of International Patent Application No. PCT/NL2016/050715, filed Oct. 18, 2016, which is incorporated by reference in its entirety.

This application claims priority to Netherlands Patent Application No. 2015635, filed Oct. 18, 2015, and Netherlands Patent Application No. 2016568, filed Apr. 8, 2016, both of which are incorporated by reference in their entirety.

BACKGROUND AND DESCRIPTION OF THE INVENTION

The invention is directed to a shipping container for transporting works of art.

Shipping containers for transporting works of art are for example described in U.S. Pat. No. 4,664,254. This publication describes a reusable container made of two halve composite shells. The assembled shells form a space for the work of art. The assembled shells are placed on a specially adapted pallet. The pallet has to be removed before the container can be opened. A disadvantage of this art container is that it is cumbersome to open and close the container.

A more practical and commercially used art container is the so-called Turtle® art container. Turtle® is a registered trademark of Turtle BV in The Netherlands. This art container is made of two halves of composite material and provided with a soft foam at its interior to protect the pieces of art to be transported.

A disadvantage of these known reusable art containers is that they require to be positioned horizontally such that the works of art can be placed into the container. This is not desired because of space restrictions and because it is preferred to maintain the vertical orientation of the works of art, especially paintings, as they would be exposed on the wall of a museum and the like.

The following shipping container does not have such a disadvantage. A shipping container for transporting works of art comprising:

an enclosing section comprising a flat rectangular wall segment and four wall sections adjoining said flat wall segment, wherein the enclosing section is a single structural element obtained by injection moulding and wherein the flat wall segment and the four wall sections define a space for the works of art to be transported, a cover section comprising a flat rectangular wall section and wherein the cover section is a single structural element obtained by injection moulding, retaining means to secure the cover section to the wall sections of the enclosing section, wherein the retaining means are not present on at least one wall section and wherein said one wall section which is not provided with retaining means is provided with one or more support strips along the length of the side wall.

Applicants found that with the shipping container according to the invention it is possible to simply remove the cover section from the enclosing section while the shipping container itself is vertically positioned on its one or more support strips. Further advantage will be described when discussing the preferred embodiments below.

The enclosing section and the cover section is suitably separately obtained as a single structural element by vacuum injection moulding of an outer layer of fibre reinforced polymer, a structural core and an inner layer of a fibre reinforced polymer. Examples of suitable polymers are polyester, epoxy resin, vinyl ester resin, acrylic resin, polyurethane, furanic type polymers or phenolic resin. The fibre may be glass fibre reinforcement mats and woven or stiched rovings, aramid or carbon fibre mats and woven or stiched rovings or mats of natural fibres like Flax and hemp. Between the two layers a structural core is present. Examples of suitable structural cores are rigid foams as for example polyurethane foam (PUR foam), polyisocyanurate foam (PIR foam), EPS foam (polystyrene), PVC foam, acrylic foam, PET foam. The structural core preferably has good thermal insulation properties. The thermal conductivity as expressed by the K-value of suitable structural core materials is suitably between 0.015 and 0.04 W/m-K and more suitably between below 0.035 W/m-k.

The structural elements are suitably made by vacuum injection moulding of an outer layer of fibre reinforced polymer, a structural core and an inner layer of a fibre reinforced polymer making use of a mould having the shape of the exterior of the cover section and enclosing section respectively. The layers are placed in the mould in accordance with the desired shape to be achieved and polymer is added under vacuum preferably using a vacuum bag. A pigmented gel coat may be present to cover the outer layer and provide a pigmented appearance of the exterior of the shipping container. Such a layer is suitable added as a first layer onto the mould followed by the outer layer of fibre reinforced polymer, the structural core and the inner layer of a fibre reinforced polymer.

The thickness of the finished outer layer of fibre reinforced polymer, a structural core and an inner layer of a fibre reinforced polymer is suitably between 0.03 and 0.05 m. Too thin would result in a shipping container not having enough strength and insulation capacity and too large would result in a too heavy shipping container.

The cover section and the enclosing section are connected when secured to one another. Suitably the retaining means are present on the two side wall sections adjoining the wall section which is not provided with retaining means. Suitably two or more retaining means are present at these two wall sections. In use these wall sections will face the user when the shipping container is positioned in its preferred vertical orientation. This will thus enable easy access to the retaining means when the user intends to open or close the shipping container.

Suitably the two side wall sections adjoining the wall section which is not provided with retaining means are provided with a handle. A handle will be used to carry the shipping container. The preferred shipping container is not provided with wheels and will have to be carried. By having handles at the specified side wall sections the shipping container can be carried positioned in its preferred vertical orientation.

The cover section and enclosing section are not linked by hinges or the like. This enables one to remove the cover section in total away from the enclosing section thereby avoiding that the vertically positioned enclosing section can tip over. To enable easy placing of such a separate cover section onto the enclosing section it is preferred that the cover section has a rectangular shape provided with four side ends which ends are flush with the four wall sections of the enclosing section when the cover section and enclosing section are secured by the retaining means.

Suitably the four corners of the enclosing section as defined by the flat rectangular wall segment and four wall sections are provided with a corner buffer. Suitably the four corners of the cover section are provided with a corner buffer. Suitably these corner buffers are made of the same material. Suitable materials are natural or synthetic rubber and polyurethane. Suitably all eight corner buffers extend away in every direction from the secured cover and enclosing sections except from away the wall section which is provided with the support strips.

The support strips are preferably made of a material which has a good mechanical strength. Preferably an engineering plastic is used such as for example acrylonitrile butadiene styrene (ABS), polycarbonates and polyamides (nylons).

Suitably one of the support strips has a flat surface facing the wall section of the enclosing section wherein part of the flat surface is fixed along its length to said wall section and wherein part of the remaining surface of the support strip along its length faces one end of the cover section when the cover section is secured to the enclosing section. Such a design enables one to more easily position the cover section when securing this section to the enclosing section.

Suitably the interior of the flat rectangular wall segment and the four wall sections of the enclosing section and the interior of the cover section are at least partly provided with a layer of a deformable foam. This deformable foam will further cushion the work of art when the shipping container is moved. The deformable foam is preferably a foam which also has good insulation properties. The thermal conductivity as expressed by the K-value of the deformable foam is suitably lower than 0.08 W/m-K. Examples of suitable deformable foams are polyurethane foams.

Suitably on top of the flat rectangular wall segment of the enclosing section a layer of a deformable foam, a layer of wood is present. The layer of preferably untreated wood or untreated plywood is advantageous because it can absorb moisture and thus assist in keeping the level of moisture low.

In order to achieve an even better insulated container it is preferred to position a so-called vacuum insulated panel between the above described layer of foam and the interior of the flat rectangular wall segment and the four wall sections of the enclosing section and the interior of the cover section. Preferably a flat panel is positioned at each of these planes. Such panels may partly overlap at the corner positions at which they meet. The vacuum insulated panels comprise of a core of insulating material as present in a flexible container which is vacuum sealed. The exterior is suitably covered by a reflecting material such as aluminium foil to further enhance the insulating properties. The core of insulating material may be for example an open cell micro fleece, glass wool fibres, fumed silica or polyurethane. Preferably glass wool or open cell micro fleece is used because of its good insulating properties and because of the size of the used core material. For example the glass fibres of the glass wool have a larger dimension than fumed silica. This is especially desired in case such a panel would lose material from its core and when such material would then be exposed to the pieces of art. The glass fibres can be easily separated from the works of art while the nano-sized silica particles would more likely stick to the surfaces of the works of art. Such vacuum insulated panels are known and can for example be obtained from Va-Q-tec AG, Würzburg, Germany.

In a preferred embodiment a layer suited to make a Velcro type (i.e., hook and loop) connection with another sheet is present on top of the layer of wood. Suitably the container further comprise one or more corner elements which can be fastened to the layer suited to make a Velcro type connection by means of a Velcro type connection as for example described in Netherlands patent publication NL1004045, which is incorporated by reference in its entirety. An advantage of such a system is that the corner pieces can be positioned exactly where they are required to support the work of art. Preferably the corner elements comprise a seat for accommodating the corner of a work of art and wherein the distance between the seat and the layer suited to make a Velcro type connection can be adjusted. In this manner it is possible to adjust the seats of the corner pieces such that a clamping fixation is achieved of the work of art, the corner pieces and the interior of the cover section.

BRIEF DESCRIPTION OF THE DRAWINGS

The invention shall be illustrated by FIGS. 1-3.

DETAILED DESCRIPTION OF THE INVENTION

Figure 1:
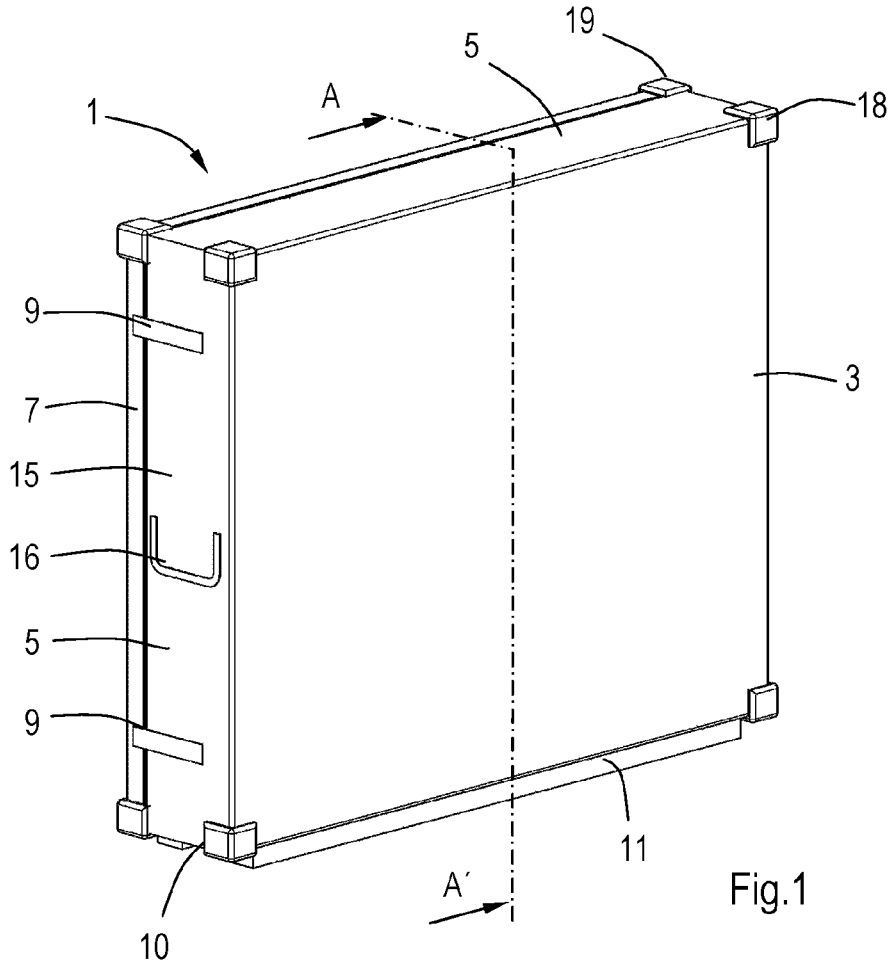
FIG. 1 shows the exterior of the shipping container according to the invention.

FIG. 1 shows a shipping container 1 for transporting works of art 2, an enclosing section 3 comprising a flat rectangular wall segment 4 and four wall sections 5 adjoining said flat wall segment 4. FIG. 1 further shows retaining means 9 to secure the cover section 7 to the wall sections 5 of the enclosing section 3. As shown the retaining means 9 are not present on at least one wall section 10. Retaining means 9 may be clasps or outer suitable suitcase closures. This wall section is provided with two support strips 11 along the length of the wall section 10. Also shown is a handle 16 as present on the two side wall sections 15 adjoining the wall section 10.

FIG. 1 illustrates a shipping container wherein the cover section 7 has a rectangular shape provided with four side ends 17 which ends 17 are flush with the four wall sections 5 of the enclosing section 3 when the cover section 7 and enclosing section 3 are secured by the retaining means 9. The four corners of the enclosing section 7 are provided with a corner buffer 18. The four corners of the cover section are provided with a corner buffer 19. 8. As shown all eight corner buffers 18, 19 extend away in every direction from the cover and enclosing sections except from away the wall section 10 which is provided with the support strips 11.

Figure 2:
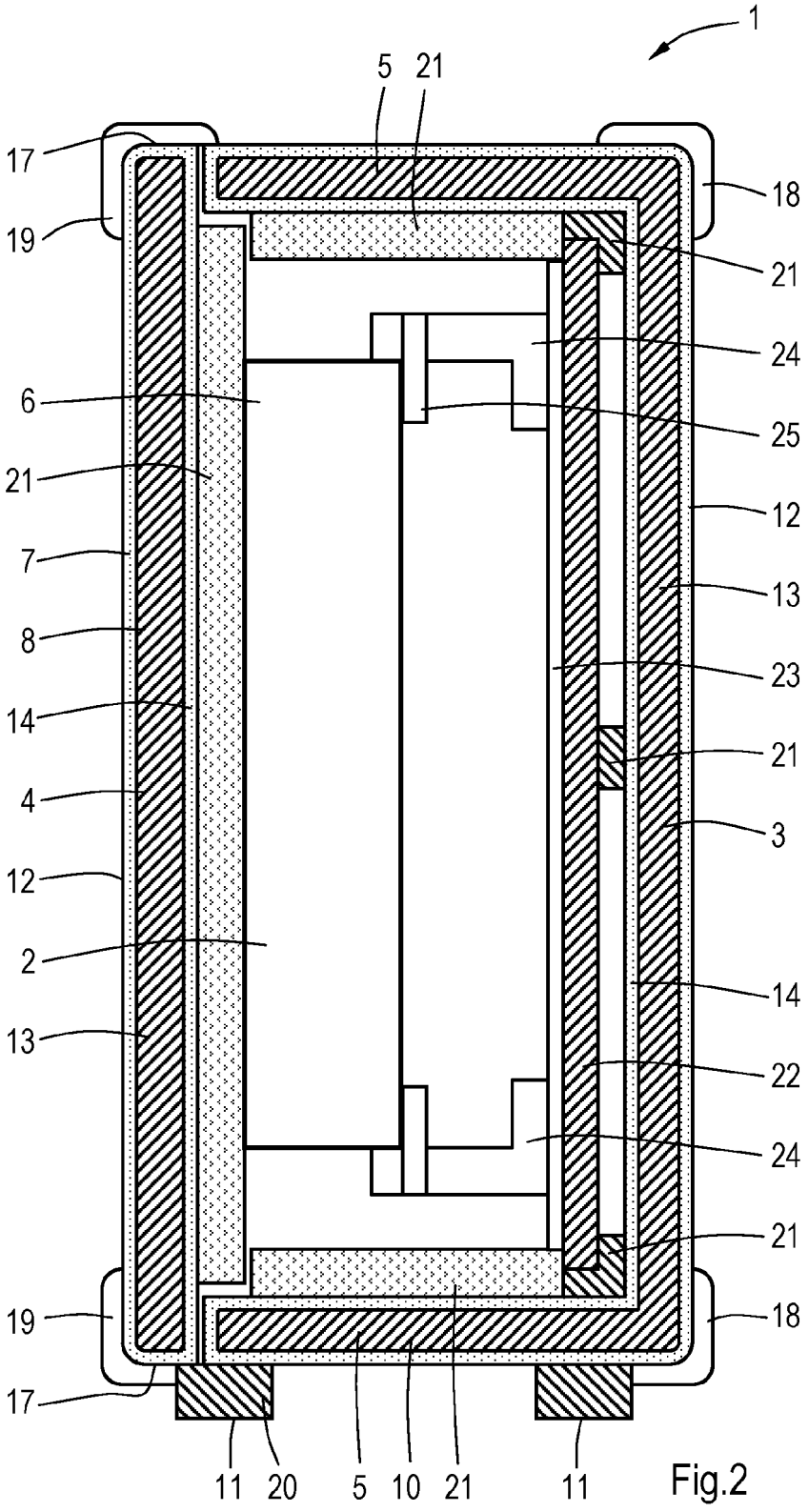
FIGS. 2 and 3 show cross-sectional views AA' as indicated in FIG. 1 for different embodiments of the invention.

FIG. 2 shows the flat wall segment 4 and the four wall sections 5 define a space 6 for the works of art 2 to be transported. Cover section 7 has a flat rectangular wall 8 section. The enclosing section 3 and the cover section 7 is separately obtained as a single structural element by vacuum injection moulding of an outer layer of fibre reinforced polymer 12, a structural core 13 and an inner layer of a fibre reinforced polymer 14.

FIG. 2 shows a support strips 20 having a flat surface facing the wall section 10 of the enclosing section 3. Part of the flat surface is fixed along its length to said side wall 10. Part of the remaining surface of the support strip 20 along its length faces one end 17 of the cover section 7.

FIG. 2 also shows a deformable foam 21 as present on the interior surface of the flat rectangular wall segment 4 and the four wall sections 5 of the enclosing section and on the interior of the cover section 7. Further is shown a layer of wood 22 and a layer 23 suited to make a Velcro type connection with another sheet. To this layer to make a Velcro type of connection a corner element 24 can be fixed by means of a Velcro type connection. Two corner elements 24 are shown supporting a work of art 2. Each corner element is provided with a seat 25 for accommodating the corner of a work of art. The distance between the seat 25 and the layer 23 can be adjusted. Alternatively, the corner element 24 can extend from layer 23 all the way up to deformable foam 21 of cover section 7 to obtain a more stable basis for the work of art 2.

Figure 3:
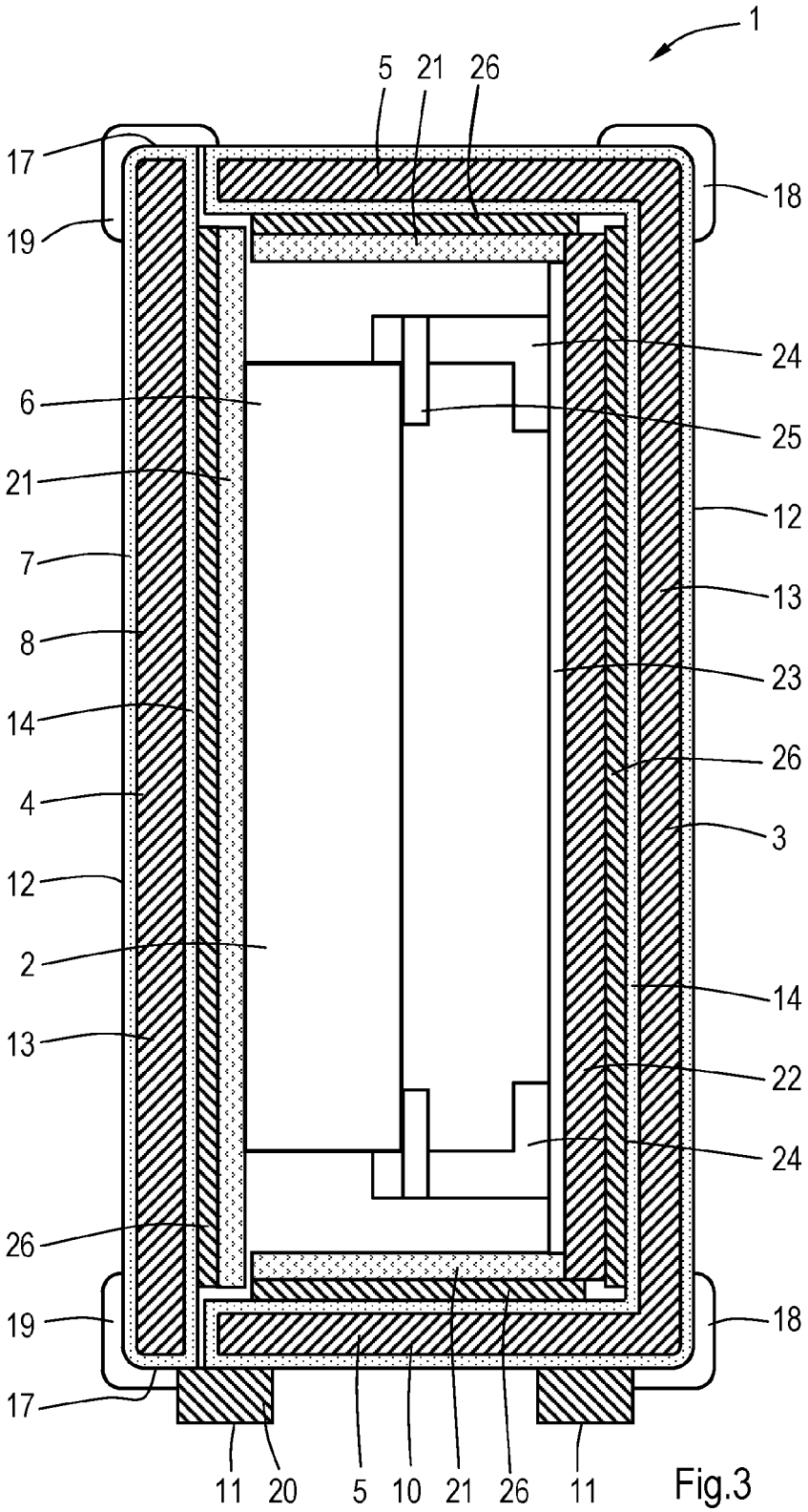

FIG. 3 shows the same shipping container as in FIGS. 1 and 2, except that between the layer of deformable foam 21 at the interior of the flat rectangular wall segment of the cover section 7 a vacuum insulating panel 26 is present. Also between the interior of the four side walls sections 5 of the enclosing section 3 and the layer of deformable foam 21 a vacuum insulating panel 26 is present. Between the interior of the flat rectangular wall segment of the enclosing section 3 and the layer of wood 22 a vacuum insulating panel 26 is present.

The invention claimed is:

1. A shipping container for transporting works of art, the shipping container comprising:

an enclosing section comprising a flat rectangular wall segment and four wall sections adjoining the flat wall segment, wherein the enclosing section is a single structural element obtained by injection moulding and wherein the flat wall segment and the four wall sections define a space for the works of art to be transported, a cover section comprising a flat rectangular wall section, wherein the cover section is a single structural element obtained by injection moulding, retaining means for securing the cover section to the wall sections of the enclosing section, wherein the retaining means are not present on at least one wall section and wherein the one wall section that is not provided with retaining means is provided with one or more support strips along the length of the one wall section, wherein vacuum insulated panels are positioned at an interior of the flat rectangular wall segment and the four wall sections of the enclosing section and at an interior of the cover section, and wherein on top of the flat rectangular wall segment of the enclosing section a vacuum insulated panel, a layer of wood, and a layer suited to make a hook and loop type connection with another sheet are present.

2. A shipping container according to claim 1, wherein the enclosing section and the cover section are obtained as a single structural element by vacuum injection moulding of an outer layer of fibre reinforced polymer, a structural core, and an inner layer of a fibre reinforced polymer.

3. A shipping container according to claim 2, wherein a pigmented gel coat is present to cover the outer layer and provide a pigmented appearance to the exterior of the shipping container.

4. A shipping container according to claim 1, wherein the retaining means are present on two of the wall sections adjoining the wall section that is not provided with retaining means.

5. A shipping container according to claim 4, wherein handles are provided to the two wall sections adjoining the wall section that is not provided with retaining means.

6. A shipping container according to claim 1, wherein the cover section has a rectangular shape provided with four side ends which ends are flush with the four wall sections of the enclosing section when the cover section and enclosing section are secured by the retaining means.

7. A shipping container according to claim 6, wherein four corners of the enclosing section as defined by the flat rectangular wall segment and the four wall sections are provided with a corner buffer, and wherein four corners of the cover section are provided with a corner buffer.

8. A shipping container according to claim 7, wherein all eight corner buffers extend away in every direction from the cover and enclosing sections except from away the one wall section which is provided with the support strips.

9. A shipping container according to claim 6, wherein the shipping container includes a plurality support strips and one of the support strips has a flat surface facing the wall section of the enclosing section, wherein part of the flat surface is fixed along its length to the wall section, and wherein part of the remaining surface of the support strip along its length faces one end of the cover section when the cover section is secured to the enclosing section.

10. A shipping container according to claim 1, wherein an interior of the flat rectangular wall segment and the four wall sections of the enclosing section and an interior of the cover section are at least partly provided with a layer of a deformable foam.

11. A shipping container according to claim 1, wherein the vacuum insulated panels are comprised of a core of glass wool.

12. A shipping container according to claim 1, wherein the container further comprises one or more corner elements that can be fastened to the layer suited to make a hook and loop type connection by means of a hook and loop type connection.

13. A shipping container according to claim 12, wherein the corner elements comprise a seat for accommodating the corner of a work of art, and wherein the distance between the seat and the layer suited to make a hook and loop type connection can be adjusted.

* * * * *